US008644716B2

(12) United States Patent
Ogawahara

(10) Patent No.: US 8,644,716 B2
(45) Date of Patent: Feb. 4, 2014

(54) HEATING DEVICE AND IMAGE FORMING APPARATUS

(75) Inventor: Norio Ogawahara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 436 days.

(21) Appl. No.: 12/941,811

(22) Filed: Nov. 8, 2010

(65) Prior Publication Data

US 2011/0236037 A1 Sep. 29, 2011

(30) Foreign Application Priority Data

Mar. 25, 2010 (JP) ..... 2010-071053

(51) Int. Cl.
*G03G 15/00* (2006.01)

(52) U.S. Cl.
USPC ..... 399/12; 399/67; 399/90; 399/328

(58) Field of Classification Search
USPC ..... 399/12, 45, 67, 69, 88, 90, 328, 330, 399/334, 335, 338; 219/216
See application file for complete search history.

(56) References Cited

U.S. PATENT DOCUMENTS

| | | | | |
|---|---|---|---|---|
| 7,310,492 | B2 * | 12/2007 | Kimura | 399/325 |
| 2006/0204251 | A1 * | 9/2006 | Ahn | 399/12 |
| 2007/0053712 | A1 * | 3/2007 | Fujiwara et al. | 399/88 |
| 2009/0103959 | A1 * | 4/2009 | Koyama et al. | 399/341 |

FOREIGN PATENT DOCUMENTS

JP 2006-330345 A 12/2006

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A heating device includes a first rotating member and a second rotating member revolving in contact with the first rotating member. The second rotating member heats a passing recording medium having a toner image and held between the first and second rotating members, thereby fixing the toner image on the recording medium. The heating device further includes a pair of supporting plates supporting the first and second rotating members by being arranged on both sides across the first and second rotating members in a width direction crossing the passing direction of the recording medium. The supporting plates each have a tabular section with a first surface facing the first and second rotating members. The heating device further includes a resistance element arranged on a second surface side opposite to the first surface of the tabular section, and representing the type of a fixing device by using resistance.

7 Claims, 11 Drawing Sheets

HEATING DEVICE AND IMAGE FORMING APPARATUS

CROSS-REFERENCE TO RELATED APPLICATION

This application is based on and claims priority under 35 USC 119 from Japanese Patent Application No. 2010-071053, filed Mar. 25, 2010.

BACKGROUND (i) Technical Field

The present invention relates to a heating device and an image forming apparatus.

(ii) Related Art

There is known an image forming apparatus that includes two types of fixing devices capable of being replaced with each other, detects a type of a replaced fixing device, and performs control corresponding to the type.

SUMMARY

A heating device according to an aspect of claim 1 includes:

a first rotating member whose circumferential surface revolves to move;

a second rotating member whose circumferential surface revolves to move in contact with the circumferential surface of the first rotating member, the second rotating member being arranged next to the first rotating member, holding in corporation with the first rotating member an object which is held between the second rotating member and the first rotating member, and heating the object while causing the object to pass according to a revolution movement of the circumferential surface;

a pair of supporting plates arranged on both sides across the first rotating member and the second rotating member in a width direction crossing a passing direction of the object, the pair of supporting plates supporting the first rotating member and the second rotating member from both the sides, and each of the pair of supporting plates whose a first surface faces the first rotating member and the second rotating member; and a resistance element arranged on a second surface side opposite to the first surface of the supporting plate with respect to either one of the pair of supporting plates, the resistance element representing a type of a heating device by using resistance.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the accompanying drawings.

Figure 1:
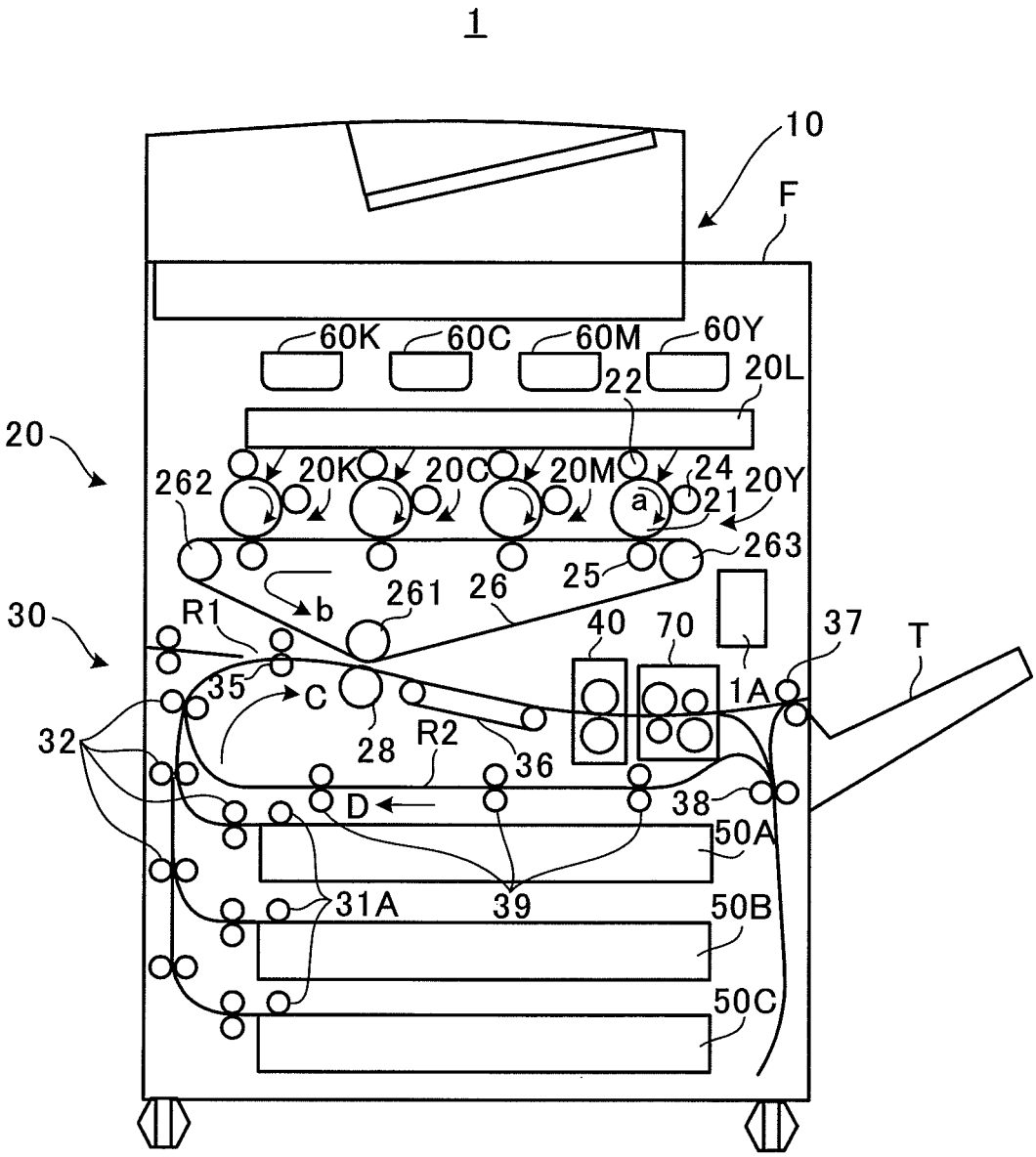
FIG. 1 is a schematic sectional view of a copying machine that is an exemplary embodiment of the image forming apparatus according to the present invention.

FIG. 1 is a schematic sectional view of a copying machine that is a first exemplary embodiment of the image forming apparatus according to the present invention.

A copying machine 1 shown in FIG. 1 includes an image reading unit 10 that reads an image from an original document and generates image data, an image forming unit 20 that forms a toner image on a sheet based on the image data, a fixing device 40 that fixes toner on the sheet, a sheet conveying unit 30 that conveys the sheet, a warp correcting device 70 that corrects a warp of the sheet, and a control unit 1A that controls each unit of the copying machine 1. The image forming unit 20, the warp correcting device 70, and the control unit 1A are housed in a housing F that supports the structure of the entire copying machine 1. The housing F includes a not-shown frame that supports the structure of the copying machine 1 and covers for an armor of the copying machine 1. The image reading unit 10 is provided in an upper part of the housing F. The copying machine 1 also includes sheet storing units 50A, 50B, and 50C that store sheets and toner storing devices 60Y, 60M, 60C, and 60K that store toners of colors YMCK used for formation of an image.

The toner image forming unit 20 includes an exposing device 20L that emits exposure light modulated based on image data and four image forming sections 20Y, 20M, 20C, and 20K on which toner images of yellow (Y), magenta (M), cyan (C), and black (K) are respectively formed. Since the four image forming sections 20Y to 20K have the same configuration, the image forming section 20Y corresponding to yellow will be representatively described. The image forming section 20Y includes a photosensitive member 21, a charging device 22 that charges the surface of the photosensitive member 21, a developing device 24 that develops the surface of the photosensitive member 21 with a toner, and a primary transfer device 25 that transfers a toner image onto an intermediate transfer belt 26. The photosensitive member 21 has a cylindrical surface and rotates in an arrow "a" direction around a cylindrical shaft.

The image forming unit 20 also includes; the intermediate transfer belt 26 onto which toner images are transferred from the photosensitive members 21 of the image forming sections 20Y to 20K; and a secondary transfer device 28 that transfers the toner images from the intermediate transfer belt 26 onto a sheet. The intermediate transfer belt 26 is an endless belt-like member supported by belt supporting rolls 261, 262, and 263. The intermediate transfer belt 26 revolves to move in a direction of an arrow "b" passing through the image forming sections 20Y to 20K and the secondary transfer device 28 in this order.

The sheet conveying unit 30 conveys a sheet along a conveying path R1 and a front and rear reversing path R2. The sheet conveying unit 30 includes: extracting rolls 31A, 31B, and 31C that extract sheets from the sheet storing units 50A, 50B, and 50C; a conveying roll 32 that conveys each of the sorted sheets; and a registration roll 35 that feeds the sheet into the secondary transfer device 28 according to timing when the secondary transfer device 28 transfers a toner image.

The sheet conveying unit 30 further includes: a belt conveying device 36 that conveys the sheet from the secondary transfer device 28 to the fixing device 40 while attracting the sheet; an output roll 37 that outputs the sheet to the outside of the copying machine 1; a switching and conveying roll 38 that switches the direction of the conveyance of the sheet and conveys the sheet; and a duplex conveyance roll 39 that conveys, for duplex printing, the sheet along the front and rear reversing path R2.

A basic operation of the image forming unit 20 shown in FIG. 1 will be described. For example, the image forming section 20Y corresponding to yellow (Y) will be representatively described. The photosensitive member 21 is driven to rotate in the arrow "a" direction and charges are given to the surface of the photosensitive member 21 by the charging device 22. The exposing device 20L irradiates the photosensitive member 21 with exposure light based on image data, thereby forming an electrostatic latent image on the surface of the photosensitive member 21. The developing device 24 develops the electrostatic latent image with a yellow toner to form a toner image. The toner is supplied to the developing device 24 of the image forming section 20Y from the toner storing device 60Y. The photosensitive member 21 holds the toner image in response to the formation of the toner image. The toner image formed on the surface of the photosensitive member 21 is transferred onto the intermediate transfer belt 26 by the primary transfer device 25.

The three image forming sections 20M to 20K corresponding to the colors other than yellow also form toner images corresponding to the respective colors in the same manner as the image forming section 20Y corresponding to yellow. The intermediate transfer belt 26 revolves to move in the direction of the arrow "b". The image forming sections 20Y to 20K transfer the toner images of the respective colors onto the intermediate transfer belt 26, so that the toner images are superimposed. In this way, the toner images corresponding to the image data are formed on the intermediate transfer belt 26. The intermediate transfer belt 26 moves while carrying the toner images.

The sheets stored in the sheet storing units 50A to 50C are extracted by the extracting rolls 31A to 31C. Each of the sorted sheets is conveyed by the conveying roll 32 on the conveying path R1 in an arrow C direction in the figure. Thereafter, the sheet is fed into the secondary transfer device 28 by the registration roll 35 and a toner image is transferred onto the sheet. The sheet is conveyed to the fixing device 40 by the belt conveying device 36 and a toner is fixed on the sheet. Thereafter, when the sheet passes through the warp correcting device 70, a warp of the sheet is corrected. The sheet is then output by the output roll 37 and laid on a stacking tray T.

When the duplex printing is executed in the copying machine 1, the sheet conveying unit 30 conveys a sheet along the front and rear reversing path R2 branching from the conveying path R1 and returning to the conveying path R1, and causes the sheet to travel in the reverse direction at a point in the front and rear reversing path R2, thereby turning the sheet upside down. More specifically, the sheet having passed through the warp correcting device 70 is conveyed in the reverse direction by switching of a conveying direction by the switching and conveying roll 38 while being conveyed by the switching and conveying roll 38. Subsequently, the sheet is conveyed in an arrow D direction in the figure along the front and rear reversing path R2 by the duplex conveyance roll 39. The sheet conveyed through the front and rear reversing path R2 returns to the conveying path R1 and passes through the conveying roll 32 and the registration roll 35 again. A toner image is transferred by the secondary transfer device 28 onto the rear surface, i.e., a surface on which the toner image is not transferred yet.

Here, the image forming unit 20 is equivalent to an example of the toner image forming unit in the present invention. The control unit 1A is equivalent to an example of the identifying unit in the present invention. In addition, the fixing device 40 is equivalent to an example of the heating device.

Figure 2:
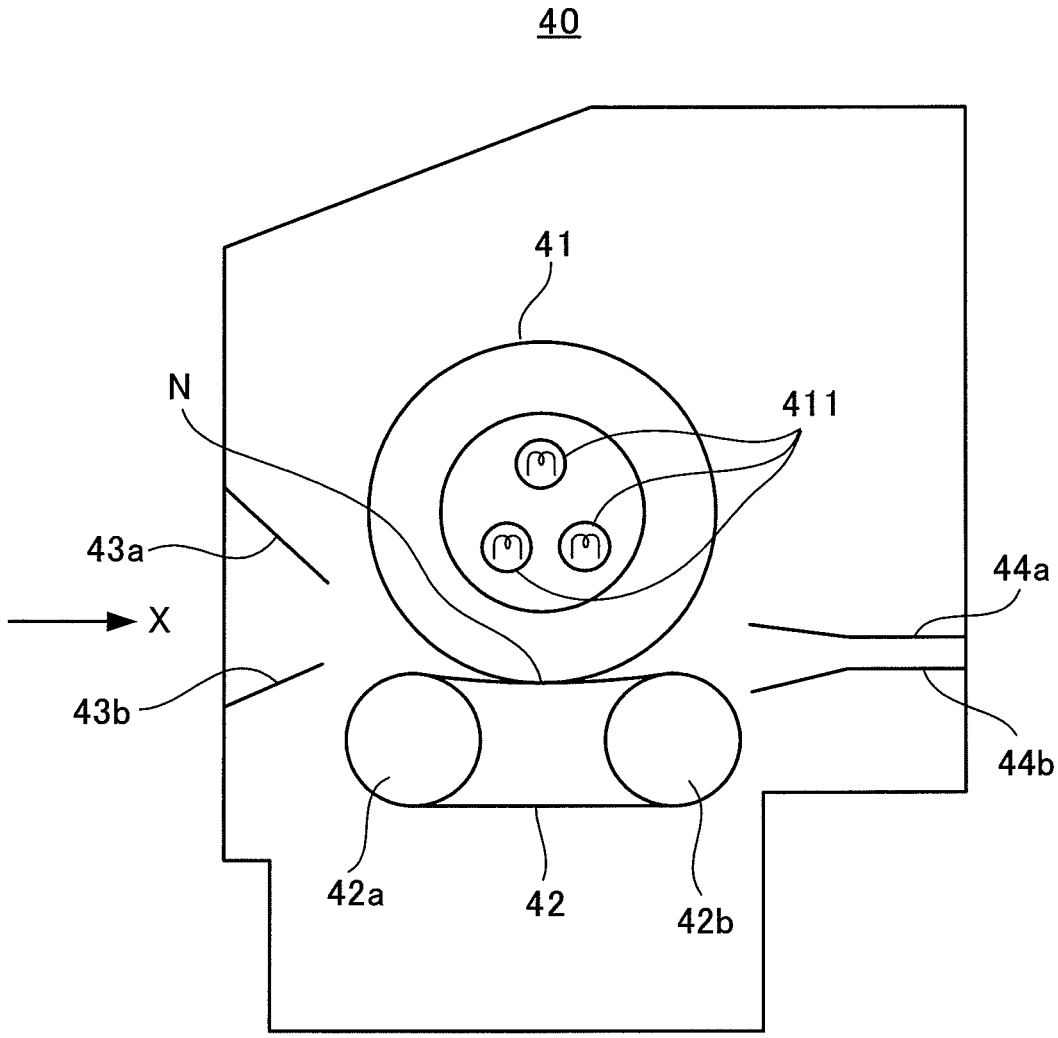
FIG. 2 is a diagram of a schematic configuration of a fixing device shown in FIG. 1.

FIG. 2 is a diagram of a schematic configuration of the fixing device shown in FIG. 1.

The fixing device 40 includes a heating roll 41 and a pressing belt 42. The heating roll 41 is formed in a cylindrical shape and includes three heater lamps 411. The pressing belt 42 is an endless belt laid over two conveying rolls 42*a* and 42*b*. The heating roll 41 is pressed against the pressing belt 42. A nip region N for nipping a sheet is formed between the heating roll 41 and the pressing belt 42. The circumferential surface of the heating roll 41 revolves to move in contact with the pressing belt 42. A toner image formed on the sheet nipped by the heating roll 41 and the pressing belt 42 comes into contact with the surface of the heating roll 41, heated by heat from the heater lamp 411, and fixed on the sheet. The fixing device heats the sheet which is an object.

Here, the heating roll 41 is equivalent to an example of the second rotating member in the present invention. The pressing belt 42 is equivalent to an example of the first rotating member in the present invention.

Guide members 43*a* and 43*b* that guide a sheet to the nip region N are provided upstream from the nip region N between the heating roll 41 and the pressing belt 42, in a conveying direction X in which the sheet is conveyed. Guide members 44*a* and 44*b* that guide the sheet, which is conveyed by the heating roll 41 and the pressing belt 42, to the warp correcting device 70 (see FIG. 1), are provided downstream from the nip region N, in the conveying direction X. The guide members 43*a* and 43*b* and the guide members 44*a* and 44*b* are arranged in positions facing both the front and rear surfaces of the conveyed sheet.

The fixing device 40 is provided to detachably attachable to the copying machine 1. From among plural types of fixing devices including the fixing device 40 shown in FIG. 2, one fixing device is selected and mounted on the copying machine 1 according to this exemplary embodiment. The fixing device can be replaced with a fixing device of another type according to a condition of use of the copying machine 1. The plural types of fixing devices have substantially the same external shapes. However, for example, materials of heating rolls and pressing belts are different from one another, and types and durability of sheets supported by the fixing devices are different. In the following description, unless otherwise specified, the fixing device 40 that belongs to one of the plural types of fixing devices will be described.

Figure 3:
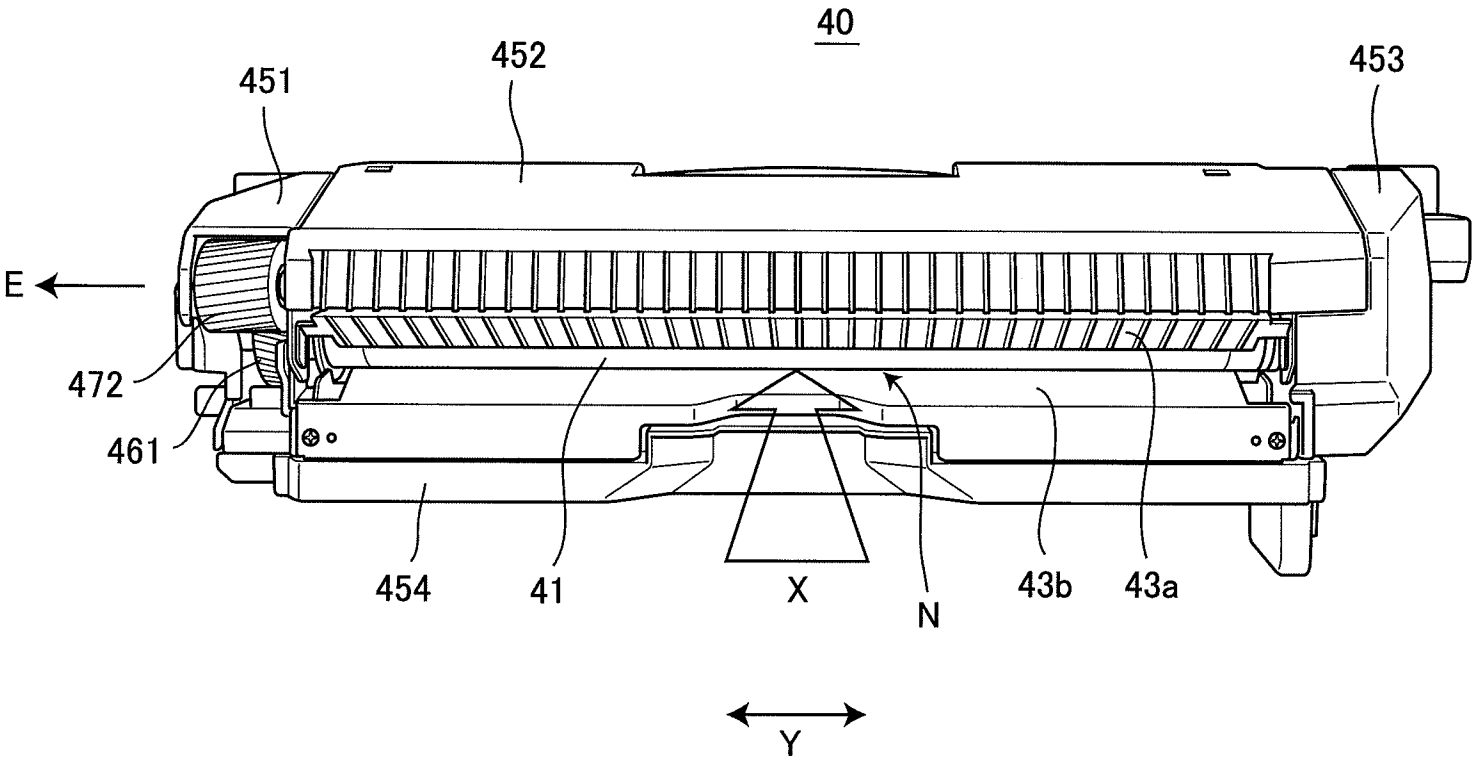
FIG. 3 is a diagram of an external appearance of the fixing device shown in FIG. 2.

FIG. 3 is a diagram of an external appearance of the fixing device shown in FIG. 2. In FIG. 3, a diagram of the fixing device viewed from the upstream side in the sheet conveying direction X in which a sheet is conveyed is shown.

The fixing device 40 is mounted on the copying machine 1 (see FIG. 1) by being inserted in a direction of an arrow E from the front side to the rear side of the copying machine 1 in a width direction Y crossing the sheet conveying direction X. Hereinafter, in the fixing device 40 as well, of the width direction Y, a side to which the arrow E points, namely the rear side of the copying machine 1, will be referred to as a rear side, and a side that is the front side of the copying machine 1 will be referred to as the front side. A sheet conveyed to the fixing device 40 in the sheet conveying direction X passes between the two guide members 43*a* and 43*b* and is fed into the nip region N between the heating roll 41 and the pressing belt 42 (see FIG. 2). Four covers 451, 452, 453, and 454 are provided in the fixing device 40. The cover 452 that is arranged in substantially the middle of the three covers 451, 452, and 453 shown in FIG. 3 and covers an upper part of the fixing device 40 will be referred to as an upper cover 452. The cover 454 that covers a lower part of the fixing device 40 will be referred to as a lower cover 454. The cover 451 arranged on the rear side is referred to as rear side cover 451. The cover 453 arranged on the front side will be referred to as a front side cover 453. The mechanism in the inside of the fixing device 40 is protected by the four covers 451, 452, 453, and 454 from being carelessly touched by an object outside the fixing device 40 or an operator. Further, in particular, heat insulation is performed by the upper cover 452 and the lower cover 454 to prevent heat in the inside of the fixing device 40 from escaping to the outside.

Rotating driving mechanisms 471 and 472 that drive the heating roll 41 are provided in the rear part of the fixing device 40. The rotation driving mechanisms 471 and 472 are gears. When the fixing device 40 is inserted in the direction of the arrow E into and mounted on the copying machine 1, a motor provided on the copying machine 1 side is connected to the rotation driving mechanism 472, and driving force is transmitted to the heating roll 41 via the rotation driving mechanism 472.

Figure 4:
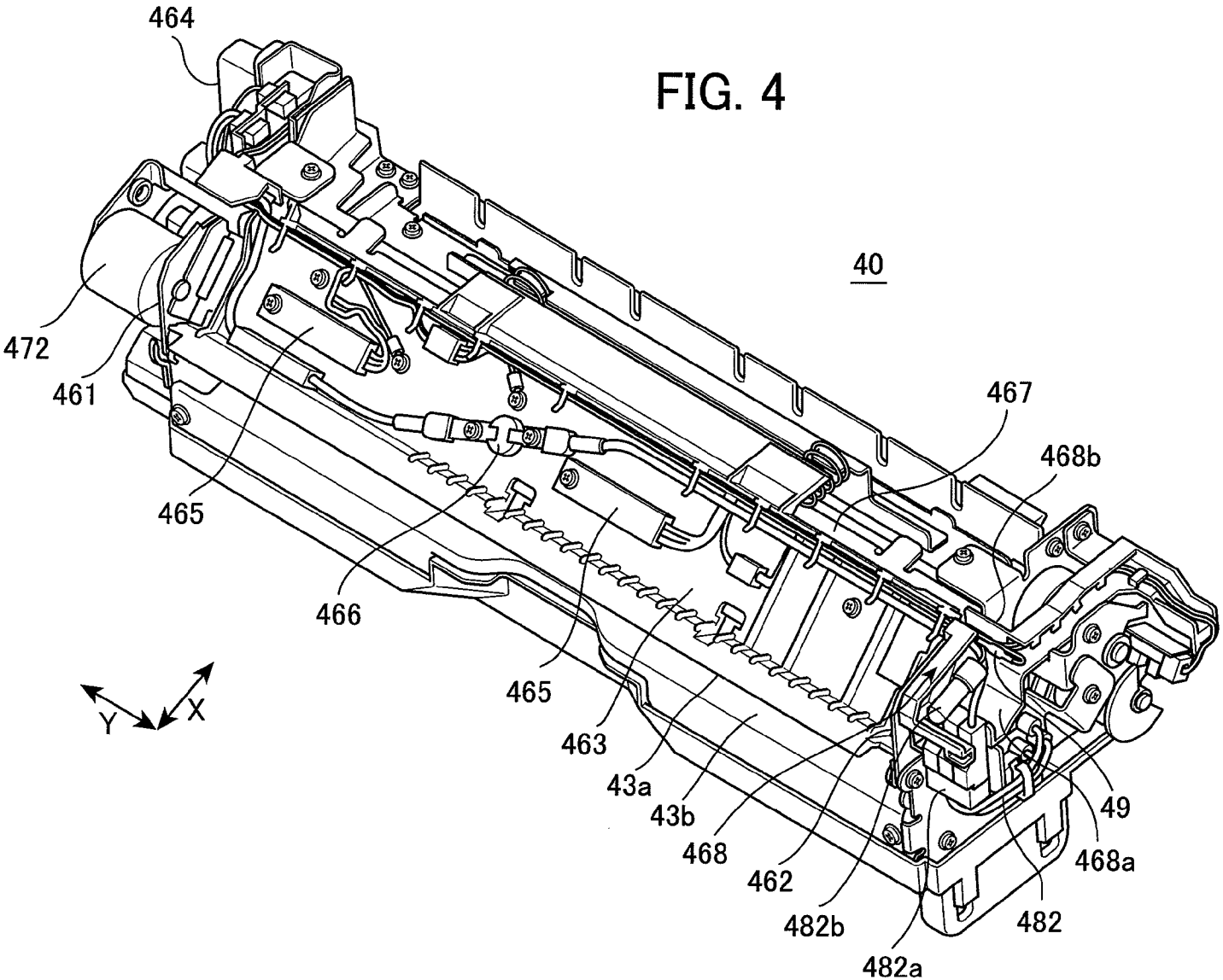
FIG. 4 is a perspective view of an internal structure of the fixing device shown in FIG. 3, from which covers are removed, viewed from above on a front side.
Figure 5:
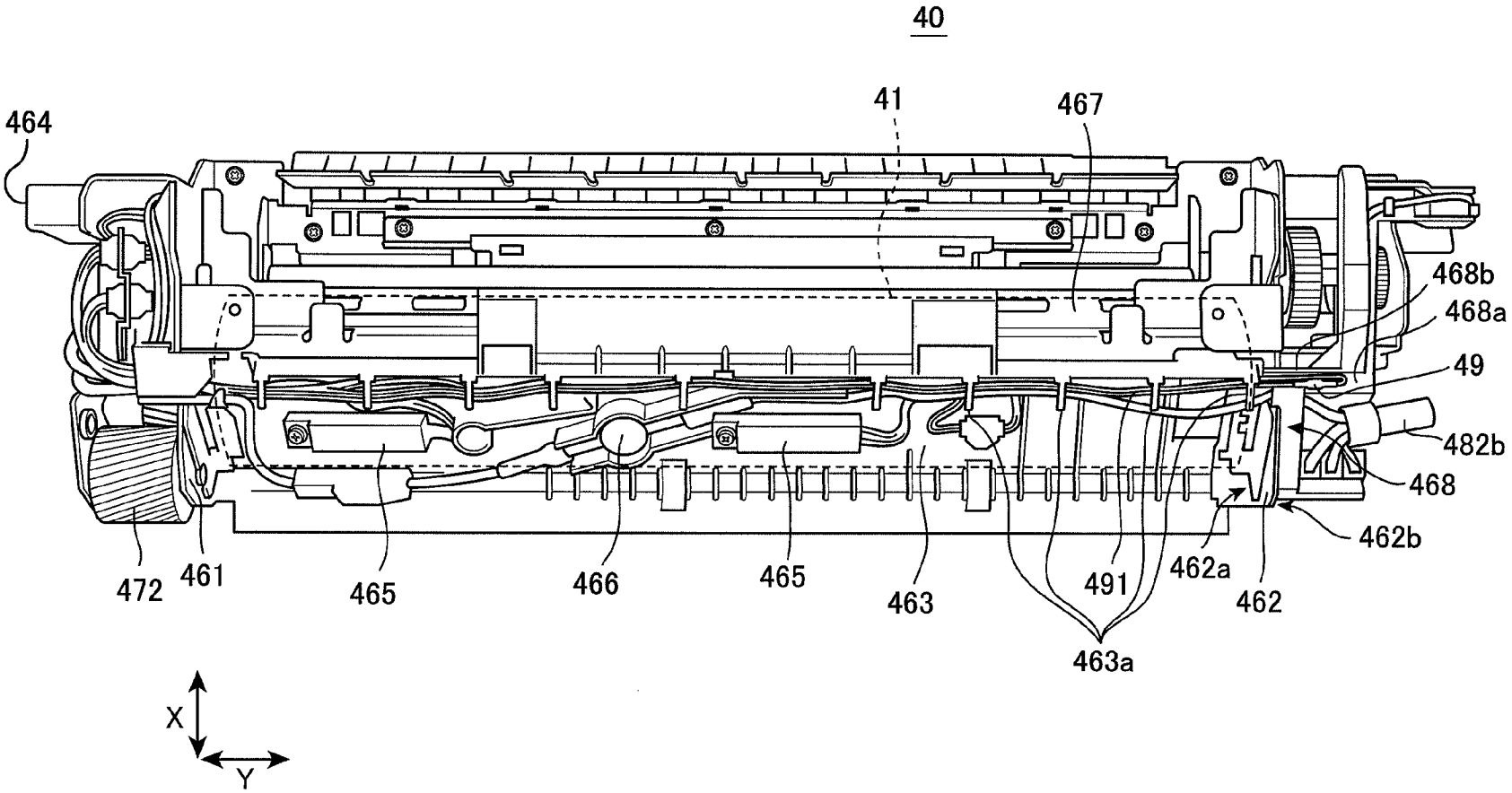
FIG. 5 is a diagram of the internal structure of the fixing device shown in FIG. 3, from which the covers are removed, viewed from above.
Figure 6:
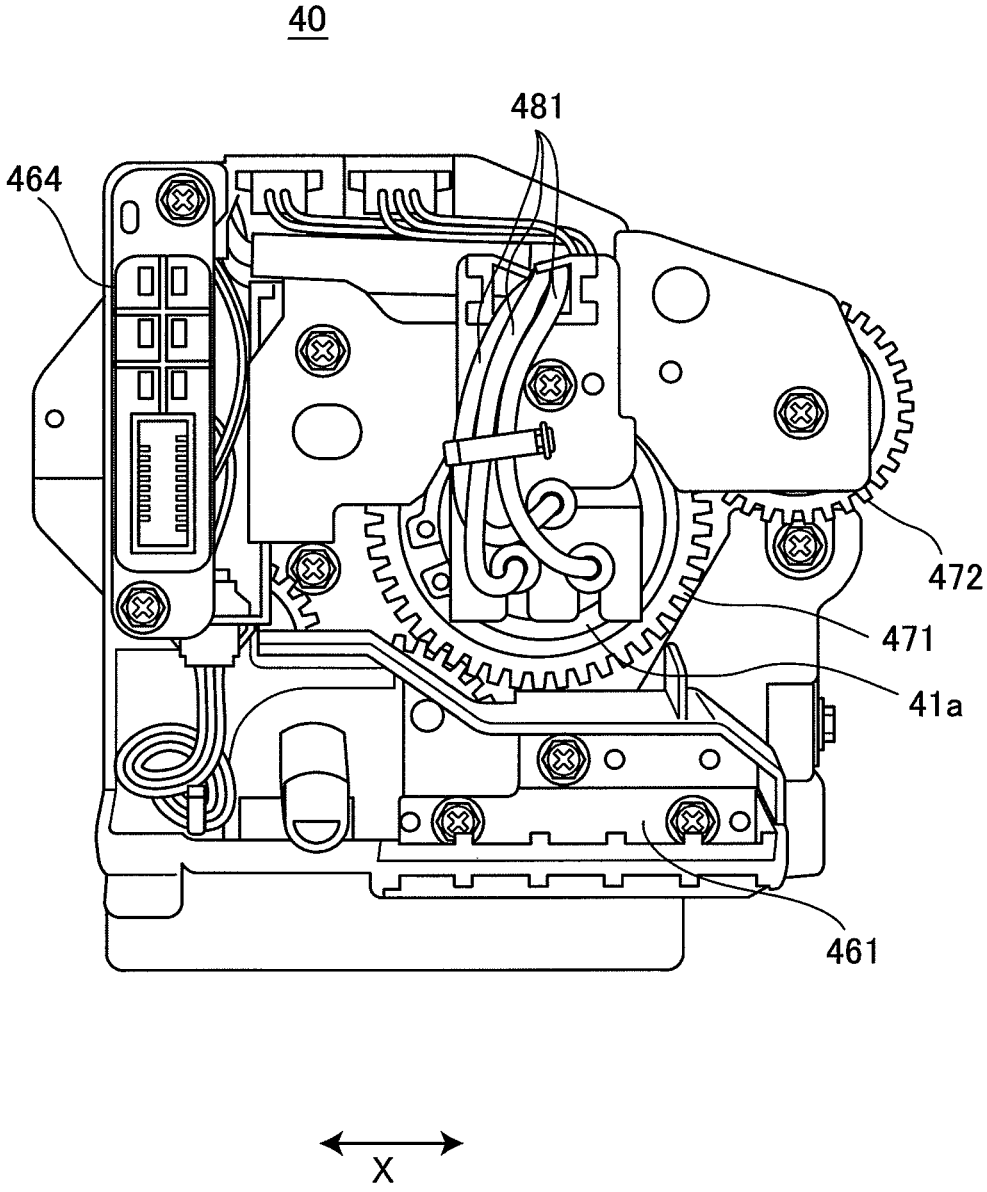
FIG. 6 is a diagram of the internal structure of the fixing device shown in FIG. 3, from which the covers are removed, viewed from a rear side.
Figure 7:
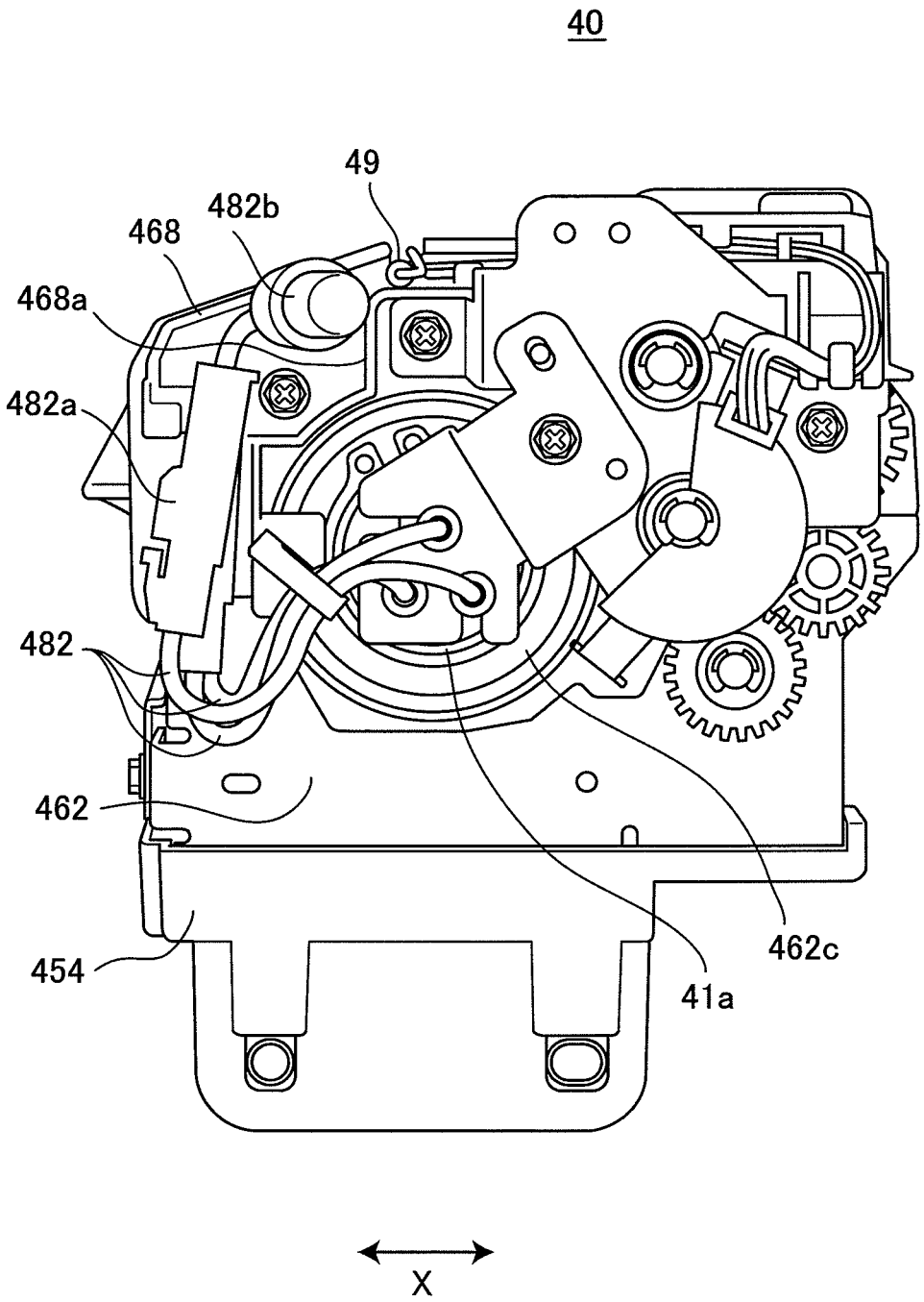
FIG. 7 is a diagram of the internal structure of the fixing device shown in FIG. 3, from which the covers are removed, viewed from the front side.
Figure 8:
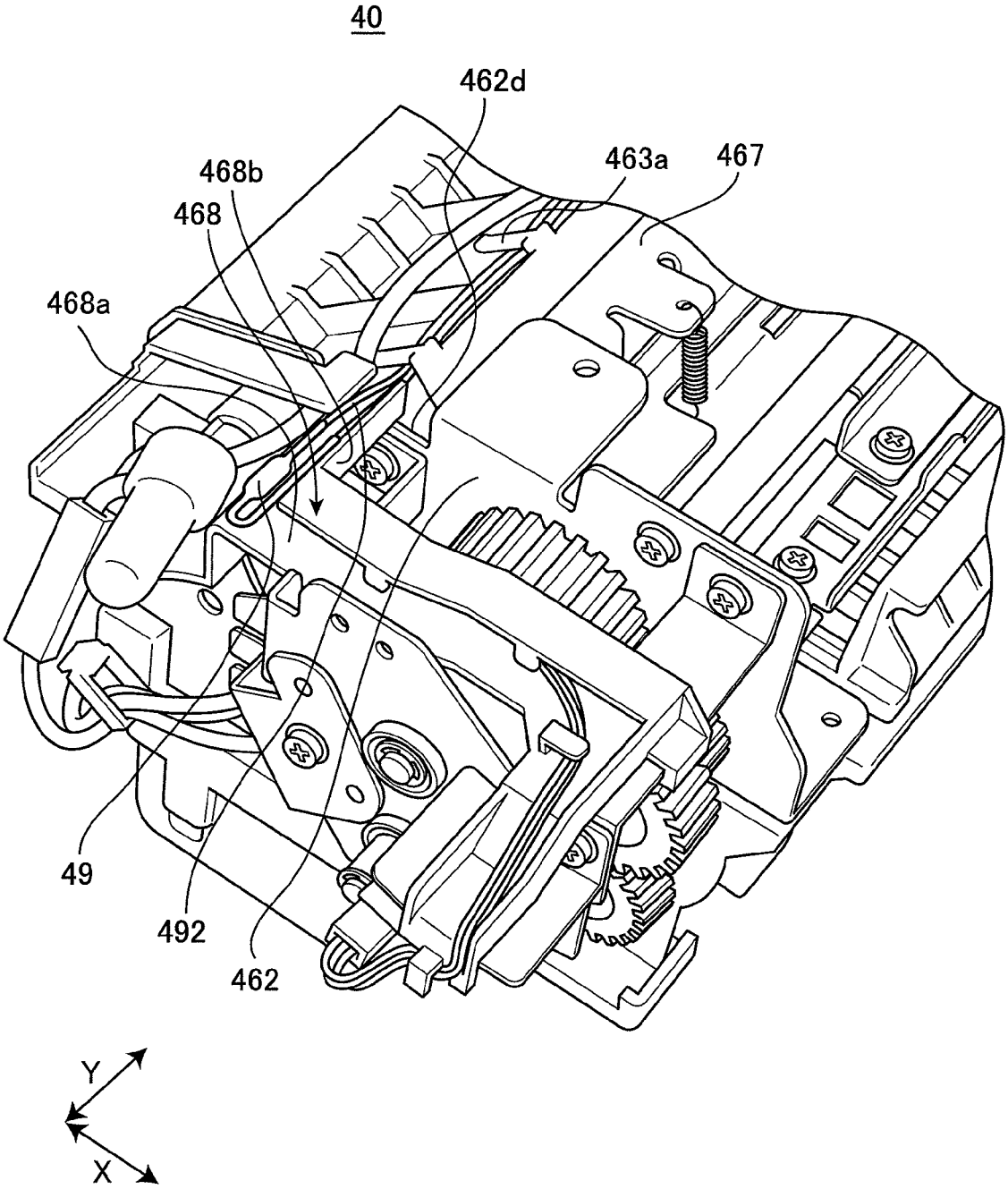
FIG. 8 is an enlarged perspective view of the front side of the fixing device shown in FIG. 3, from which the covers are removed.

FIGS. 4, 5, 6, 7, and 8 are diagrams of an internal structure of the fixing device 40 shown in FIG. 3, from which the front, rear and upper covers are removed. FIG. 4 is a perspective view of the fixing device 40 viewed from above on the front side. FIG. 5 is a diagram of the fixing device 40 viewed from above. FIG. 6 is a diagram of the fixing device 40 viewed from the rear side in the width direction. FIG. 7 is a diagram of the fixing device 40 viewed from the front side opposed to the rear side. In FIG. 5, the position of the heating roll 41 is indicated by a broken line. FIG. 8 is an enlarged perspective view of the front side of the fixing device 40.

The fixing device 40 includes, in particular, as shown in FIG. 5, a pair of supporting members 461 and 462 on both front and rear sides across the heating roll 41 and the pressing belt 42 (see FIG. 1). Of the pair of supporting members 461 and 462, the supporting member arranged on the rear side will be referred to as a rear side supporting member 461, while the supporting member arranged on the front side will be referred to as a front side supporting member 462. Each of the rear side supporting member 461 and the front side supporting member 462 has a tabular section. More specifically, the rear side supporting member 461 and the front side supporting member 462 are members obtained by punching metal plates and partially bending the metal plates. Of the front and rear surfaces of the tabular section of the front side supporting member 462, a surface facing the heating roll 41 will be referred to as an inner surface 462*a*. A surface opposite to the inner surface 462*a* will be referred to as an outer surface 462*b*. An internal space of the fixing device 40 to which the four covers 451, 452, 453, and 454 shown in FIG. 3 are attached is partitioned into a space in which the heating roll 41 and the pressing belt 42 are arranged between the front side supporting member 462 and the rear side supporting member 461, a space in front of the front side supporting member 462, and a space behind the rear side supporting member 461.

The rear side supporting member 461 is equivalent to an example of the first supporting plate in the present invention. The front side supporting member 462 is equivalent to an example of the second supporting plate in the present invention. The front side cover 453 is equivalent to an example of the cover in the present invention.

A coupling member 467 extending in the width direction Y is laid between the rear side supporting member 461 and the front side supporting member 462 in the fixing device 40. The coupling member 467 is formed by bending a metal plate. Both ends of the coupling member 467 in the width direction Y are connected to the rear side supporting member 461 and the front side supporting member 462. Besides the coupling member 467 shown in the figure, a not-shown coupling member is laid between the rear side supporting member 461 and the front side supporting member 462. The structure of the entire fixing device 40 is supported by the coupling members represented by the coupling member 467, the rear side supporting member 461, and the front side supporting member 462. A guide member 43*b* is laid between the rear side supporting member 461 and the front side supporting member 462. Further, a plate member 463 made of resin is laid above the heating roll 41, between the rear side supporting member 461 and the front side supporting member 462. The plate member 463 is formed integrally with the guide member 43*a*. A sensor 465 for measuring the temperature of the heating roll 41 and a thermostat 466 for overheat prevention are attached to the plate member 463, with the respective detection surfaces facing the heating roll 41.

The rear side supporting member 461 and the front side supporting member 462 rotatably support the heating roll 41 and the pressing belt 42 (see FIG. 2) from both the sides in the width direction Y. More specifically, as shown in FIG. 7, the rotating shaft 41*a* of the heating roll 41 is supported by a bearing member 462*c* fixed to the front side supporting member 462. The opposite side of the heating roll 41 also is supported by the rear side supporting member 461. Further, three lead wires 481 that supply electric power to the three heater lamps 411 (see FIG. 2) extend to the inside of the heating roll 41 as shown in FIG. 6. On the front side of the heating roll 41 as well, as shown in FIG. 7, three lead wires 482 that supply electric power to the heater lamps 411 extend to the inside of the heating roll 41. The three lead wires 482 are bound into one lead wire through a relay connector 482*a* and a closed end connector 482*b* and connected to the thermostat 466. A lead wire supporting member 468 that supports lead wires including the lead wires 482 is attached to the outer surface 462*b* of the front side supporting member 462. The lead wire supporting member 468 is made of resin and has a protection section 468*a* spreading in an eaves shape above an end of the rotating shaft 41*a* of the heating roll 41.

In the fixing device 40, an electric connector 464 for connection to the copying machine 1 is provided on the rear side on which the rear side supporting member 461 is provided. The lead wires 481 that supply electric power to the heater lamps 411 and lead wires for leading signals from the sensor 465 and the thermostat 466 are connected to the electric connector 464. On the rear side of the rear side supporting member 461, in particular, as shown in FIG. 6, besides the electric connector 464, a bundle of lead wires extending from the electric connector 464 and the rotation driving mechanisms 471 and 472 that drive the heating roll 41 are densely arranged.

The fixing device 40 includes a resistance element 49 used for identifying the type of a fixing device. In particular, as shown in FIG. 5, the resistance element 49 is arranged on the side of the outer surface 462*b* opposite to the inner surface 462*a* of the front side supporting member 462. More specifically, the resistance element 49 is arranged on the protection section 468*a* of the lead wire supporting member 468 arranged on the outer surface 462*b* of the front side supporting member 462. At an edge of the protection section 468*a*, an erected wall 468*b* bending upward from this edge and reaching the position of the upper cover 452 (see FIG. 3) is formed. The resistance element 49 is arranged along the erected wall 468*b*. Two lead wires 491 are connected to both ends of the resistance element 49. The resistance element 49 is electrically connected to the electric connector 464 via the lead wires 491. The lead wires 491 extend from the electric connector 464 arranged on the rear side supporting member 461 side to the front side of the front side supporting member 462. Specifically, the lead wires 491 connected to the electric connector 464 pass over the rear side supporting member 461, extend in the width direction Y between the rear side supporting member 461 and the front side supporting member 462, more specifically, over the plate member 463 arranged above the heating roll 41, passes over the front side supporting member 462 to the front side of the front side supporting member 462, and extends to above the protection section 468*a*. On the plate member 463, the lead wires 491 are held, together with the other lead wires, by hooks 463*a* arranged in plural places along the width direction Y in an upper part of the plate member 463. In particular, as shown in FIG. 8, a cutout section 462*d* that forms a hole when the upper cover 452 (see FIG. 3) is placed on the front side supporting member 462 is provided in an upper part of the front side supporting member 462. Parts of the protection section 468*a* and the erected wall 468*b* pierce through the inner side of the cutout section 462*d* and project to the rear of the front side supporting member 462. The lead wires 491 are arranged on the protection section 468*a* disposed in the cutout section 462*d*. The lead wires 491 pierce through the cutout section 462*d* and extend to the front side of the front side supporting member 462.

Figure 9:
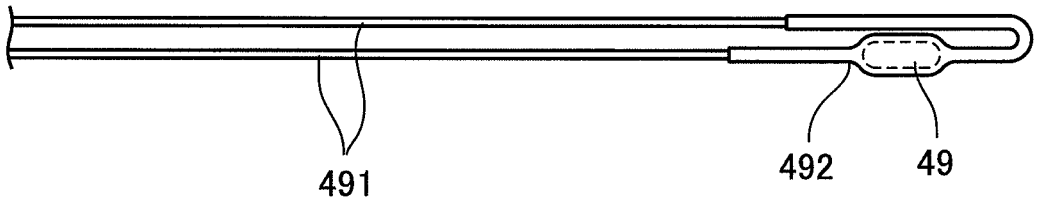
FIG. 9 is a diagram of a resistance element removed from the fixing device.

FIG. 9 is a diagram of the resistance element removed from the fixing device.

The two lead wires 491 are connected to both the ends of the resistance element 49. The resistance element 49 is covered with a tube 492 made of resin for heat insulation.

As already described, the fixing device of the type selected from among the plural types of fixing devices is mounted on the copying machine 1. The resistance of the resistance element 49 represents the type of a fixing device. A color of the lead wires 491 connected to the resistance element 49 is different depending on the type of the fixing device.

A table shown below represents a relation between types of fixing devices that can be mounted on the copying machine 1 and resistances of the resistance element and colors of the lead wires.

TABLE 1

| Type of Fixing device | Resistance (kΩ) | Color of lead wires |
|---|---|---|
| Fixing device 1 | 0 | Brown |
| Fixing device 2 | 2.4 | Red |

TABLE 1-continued

| Type of Fixing device | Resistance (kΩ) | Color of lead wires |
|---|---|---|
| Fixing device 3 | 4.7 | Orange |
| Fixing device 4 | 7.5 | Yellow |
| Fixing device 5 | 13 | Green |
| Fixing device 6 | 22 | Blue |
| Fixing device 7 | 43 | Purple |
| Fixing device 8 | Open | Gray |

For example, the fixing device 40 shown in FIGS. 3 to 8 is equivalent to "fixing device 2" in the table. The resistance of the resistance element 49 is 2.4 kΩ and the color of the lead wires 491 is red. The resistance "0" indicates a state in which the lead wires 491 are directly connected without going through the resistance element 49. "Open" indicates a state in which the lead wires 491 are not connected.

In a state in which the fixing device 40 is connected to the copying machine 1, the control unit 1A of the copying machine 1 reads out, via the electric connector 464, the resistance of the resistance element 49 connected to the electric connector 464. The resistance is read out by, for example, reading out voltage generated when electric current is fed to the resistance element 49. The resistance in the table is a standard value in the standard of resistance elements. In the standard, an error in a range of, for example, +/−10% is included in actual resistance. The control unit 1A identifies the type of a fixing device when the resistance is in a range allowing for a margin including the error in the standard of resistance elements. When the resistances of the resistance element shown in the table are used, six types of fixing devices are identified by simply providing one resistance element in a fixing device. Eight types of fixing devices in total including "0" and "open" are identified. According to the identified type of a fixing device, the control unit 1A changes electric power and a signal supplied to the fixing device. The operation of each unit in the copying machine 1 is controlled according to the type of a fixing device.

When the resistance element 49 is covered with the tube 492, indication representing the resistance on the surface of the resistance element 49 cannot be visually recognized. Therefore, when the fixing device 40 is manufactured and assembled, the indication on the surface of the resistance element 49 cannot be visually recognized. However, since the lead wires 491 projecting to the outside from the tube 492 are separated by color as shown in the table, a situation in which a resistance element having a wrong value is attached during manufacturing and assembling of the fixing device 40 is avoided.

The type of a fixing device is identified according to the resistance. However, the resistance of the resistance element 49 fluctuates according to a change in temperature. If the temperature of the resistance element 49 rises because of heat from the heating roll 41, the resistance rises to exceed the error range in the standard. This causes wrong discrimination of a type of the fixing device 40 by the control unit 1A.

In the fixing device 40 according to this exemplary embodiment, the resistance element 49 is arranged on the side of the outer surface 462*b* opposite to the inner surface 462*a* facing the heating roll 41. Therefore, radiated heat and convected heat from the heating roll 41 are blocked by the front side supporting member 462. The resistance element 49 is arranged above a section where the heater lamps 411 are exposed to the outside, at the end of the rotating shaft 41*a* of the heating roll 41. However, since the protection section 468*a* is arranged between the section where the heater lamps 411 are exposed and the resistance element 49, heat from the heater lamps 411 is blocked by the protection section 468*a*. Therefore, since fluctuation in the resistance due to the heat from the heating roll 41 is suppressed, an error in identification of the type of a fixing device is prevented. In other words, the eight types of fixing devices are identified without an error by using the resistances.

The lead wires 491 connected to the resistance element 49 are extended to the outer surface 462*b* of the front side supporting member 462 from the electric connector 464 arranged on the side of the rear side supporting member 461. The resistance element 49 is arranged on the outer surface 462*b* of the front side supporting member 462. On the rear side of the rear side supporting member 461, in particular, as shown in FIG. 6, besides the electric connector 464, the bundle of the lead wires extending from the electric connector 464 and the rotation driving mechanisms 471 and 472 that drive the heating roll 41 are densely arranged. On the other hand, on the side of the outer surface 462*b* of the front side supporting member 462, i.e., the front side of the front side supporting member 462, as shown in FIGS. 7 and 8, a rotation driving mechanism for the heating roll 41 is not arranged and an electric connector for connection to the copying machine 1 is not arranged either. Further, among the lead wires extending from the electric connector 464, only a part of the lead wires extend to the side of the outer surface 462*b* of the front side supporting member 462. Therefore, a larger space for air flow is secured on the side of the outer surface 462*b* of the front side supporting member 462 than on the rear side of the rear side supporting member 461. Therefore, when the resistance element 49 is arranged on the side of the outer surface 462*b* of the front side supporting member 462, a rise in temperature of the resistance element 49 is suppressed more than when the resistance element 49 is arranged on the rear side of the rear side supporting member 461. Therefore, an error in discrimination of the type of the fixing device 40 is prevented.

Figure 10:
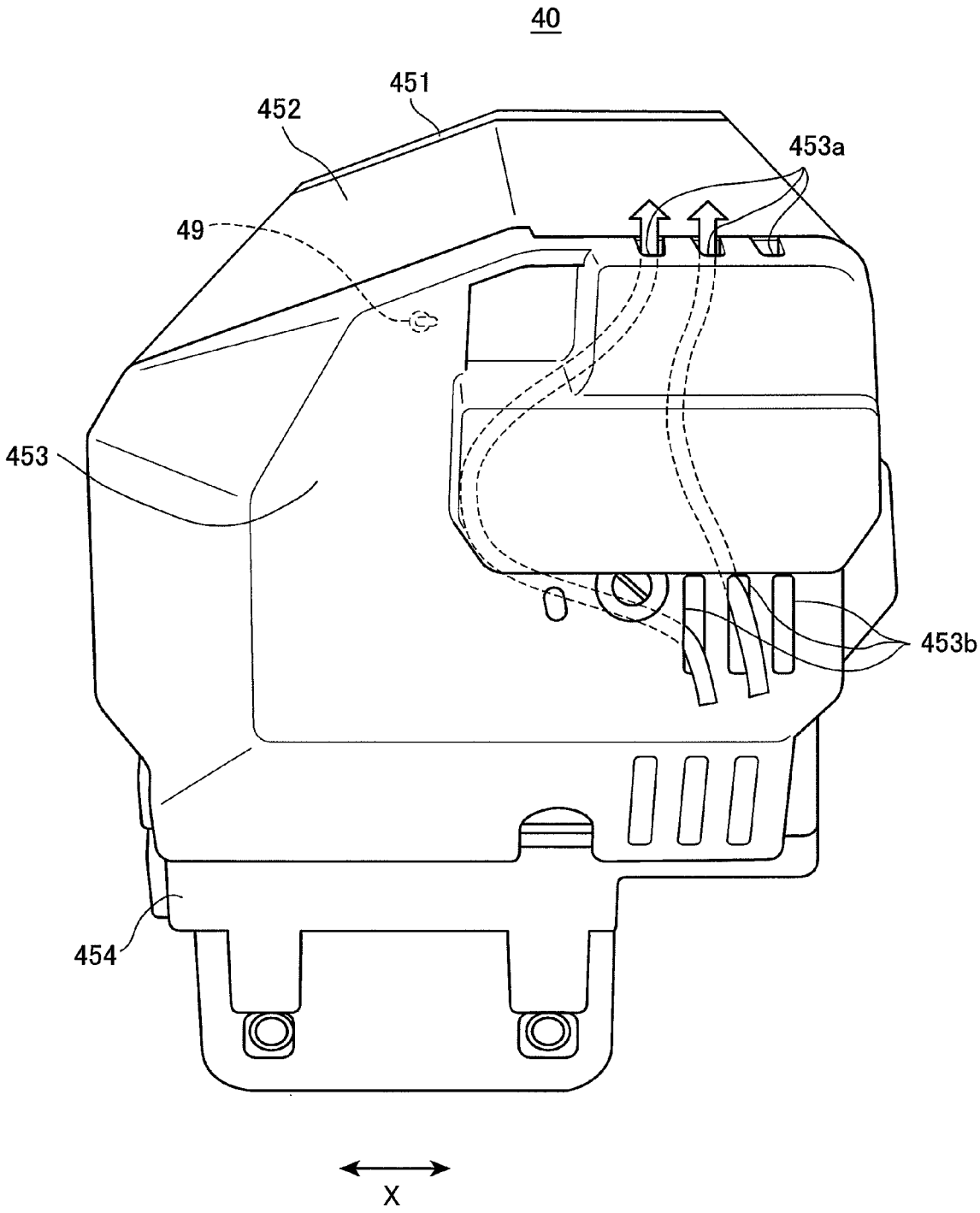
FIG. 10 is a diagram of the fixing device, to which the covers are attached, viewed from the front side.

FIG. 10 is a diagram of the fixing device, to which the covers are attached, viewed from the front side. In a state in which the rear side cover 451, the upper cover 452, and the front side cover 453 are attached, the outer surface 462*b* of the front side supporting member 462 is covered by the upper cover 452 and the front side cover 453. In this state, the resistance element 49 is included in the upper cover 452 and the front side cover 453. Vent holes 453*a* and 453*b* are respectively provided in an upper part and a lower part of the front side cover 453. The air entering the inside of the front side cover 453 from the vent hole 453*b* in the lower part is released to the outside from the vent hole 453*a* in the upper part. Therefore, heat is emitted from a space covered by the upper cover 452 and the front side cover 453, which suppresses a rise in temperature of the resistance element 49.

Figure 11:
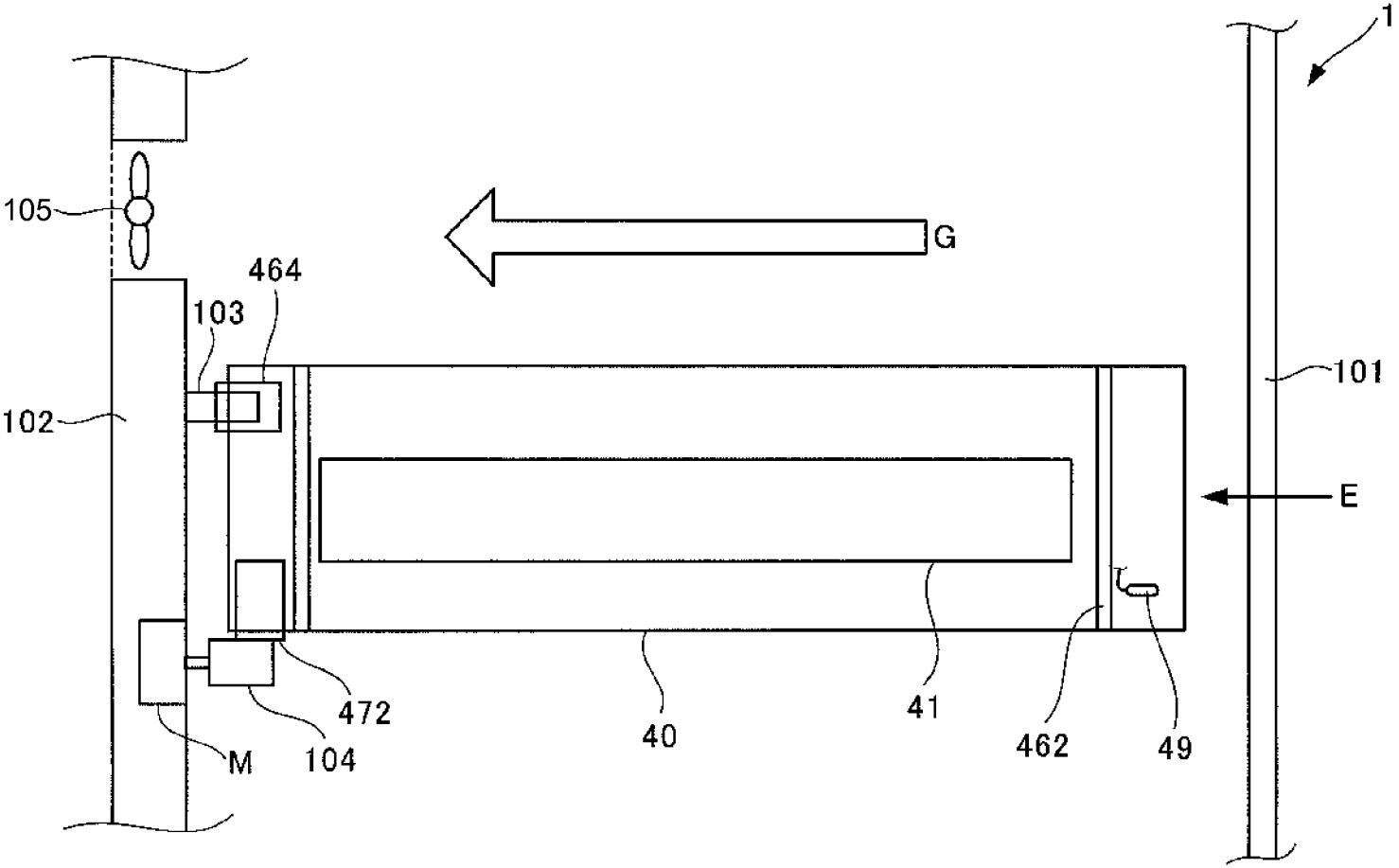
FIG. 11 is a schematic diagram of an internal structure of a section, into which the fixing device is inserted, of the copying machine shown in FIG. 1.

FIG. 11 is a schematic diagram of an internal structure of a section where the fixing device is mounted in the copying machine 1 shown in FIG. 1. In FIG. 11, the structure of the inside of the copying machine 1 and the fixing device 40 viewed from above is shown.

The fixing device 40 is mounted by opening a door 101 attached to the front surface of the copying machine 1 and inserting the fixing device 40 in a backward direction indicated by an arrow E. In the mounted state, the electric connector 464 of the fixing device 40 is connected to a mating connector 103 provided in a supporting section 102 in a rear part of the copying machine 1. The rotation driving mechanism 472 is connected to a motor M via a gear 104. A fan 105 that releases the air in the inside of the copying machine 1 is provided in the rear part of the copying machine 1. The air near the fixing device 40 is caused to flow in a direction indicated by an arrow G from the front to the rear by the fan 105. The resistance element 49 of the fixing device 40 is arranged further on the front side of the front side supporting member 462 arranged in front of the heating roll 41. Therefore, since the resistance element 49 is located upstream from the heating roll 41 in the flow of the air, fluctuation in the resistance due to the heat from the heating roll 41 is suppressed and an error in identification of the type of a fixing device is prevented.

In the exemplary embodiment described above, the pressing belt 42 is described as an example of the first rotating member in the present invention. However, the first rotating member in the present invention is not limited to this example and may be, for example, a cylindrical roll. Further, the cylindrical heating roll 41 is described as an example of the second rotating member in the present invention. However, the second rotating member in the present invention is not limited to this and may be, for example, an endless belt.

In the exemplary embodiment, as an example of the type of the device in the present invention, the eight types of fixing devices including "0" and "open" is described as being identified. However, the present invention is not limited to this example. The number of types of fixing devices to be identified only has to be an arbitrary number equal to or larger than two. In addition, the heating device according to the present invention may be any device as far as the device heats an object, and is not limited to a fixing device. For example, an image forming apparatus may be one which incorporates plural kinds of heating devices, and identifies the kinds of the plural heating devices.

In the exemplary embodiment, the color copying machine is described as an example of the image forming apparatus. However, the image forming apparatus in the present invention is not limited to this example, and may be, for example, a monochrome copying machine, a printer, or a facsimile.

In the exemplary embodiment, the sheet made of paper is described as an example of the recording medium in the present invention. However, the recording medium in the present invention is not limited to this example and may be, for example, a sheet made of resin.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a first rotating member whose circumferential surface revolves to move;

a second rotating member whose circumferential surface revolves to move in contact with the circumferential surface of the first rotating member, the second rotating member being arranged next to the first rotating member, holding in corporation with the first rotating member an object which is held between the second rotating member and the first rotating member, and heating the object while causing the object to pass according to a revolution movement of the circumferential surface;

a pair of supporting plates arranged on both sides across the first rotating member and the second rotating member in a width direction crossing a passing direction of the object, the pair of supporting plates supporting the first rotating member and the second rotating member from both the sides, and each of the pair of supporting plates whose a first surface faces the first rotating member and the second rotating member; and a resistance element arranged on a second surface side opposite to the first surface of the supporting plate with respect to either one of the pair of supporting plates, the resistance element having a specific resistance matching one of at least three resistance values, each of the at least three resistance values representing a different heating device type, wherein;

the specific resistance of the resistance element corresponds to the heating device type of the heating device; and the heating device type of the heating device is identified by an identifying unit that determines whether or not a difference between a resistance value of a resistance element attached to an outer frame of the heating device and a resistance value determined according to each of at least three different heating device types is within a predetermined range.

2. The heating device according to claim 1, further comprising:

an electric connector provided on a side of the heating device, on which side a first supporting plate of the pair of supporting plates is provided, the electric connector being provided to perform electrical connection to an external connection device of the heating device; and a pair of lead wires extending from the electric connector to a side beyond a second supporting plate different from the first supporting plate of the pair of supporting plates, wherein the resistance element is arranged on the second surface side of the second supporting plate, and both ends of the resistance element are connected to the pair of lead wires.

3. The heating device according to claim 1, further comprising a cover that has a vent hole and covers at least the second surface of the second supporting plate while including the resistance element.

4. An image forming apparatus comprising:

a fixing device comprising:

a first rotating member whose circumferential surface revolves to move;

a second rotating member whose circumferential surface revolves to move in contact with the circumferential surface of the first rotating member, the second rotating member being arranged next to the first rotating member, holding in corporation with the first rotating member an object which is held between the second rotating member and the first rotating member, and heating the object while causing the object to pass according to a revolution movement of the circumferential surface;

a pair of supporting plates arranged on both sides across the first rotating member and the second rotating member in a width direction crossing a passing direction of the object, the pair of supporting plates supporting the first rotating member and the second rotating member from both the sides, and each of the pair of supporting plates whose a first surface faces the first rotating member and the second rotating member; and a resistance element arranged on a second surface side opposite to the first surface of the supporting plate with respect to either one of the pair of supporting plates, the resistance element having a specific resistance matching one of at least three resistance values, each of the at least three resistance values representing a different heating device type, the specific resistance of the resistance element corresponding to the heating device type of the fixing device; and an identifying unit that acquires an electric signal, which has passed through the resistance element, determines the specific resistance, and identifies the heating device type by determining whether or not a difference between the determined specified resistance and a resistance value determined according to each of at least three different heating device types is within a predetermined range.

5. The image forming apparatus according to claim 4, wherein the fixing device further includes:

an electric connector provided on a side of the fixing device, on which side a first supporting plate of the pair of supporting plates is provided, the electric connector being provided to perform electrical connection to an external connection device of the fixing device; and a pair of lead wires extending from the electric connector to a side beyond a second supporting plate different from the first supporting plate of the pair of supporting plates, wherein the resistance element is arranged on the second surface side of the second supporting plate, and both ends of the resistance element are connected to the pair of lead wires.

6. The image forming apparatus according to claim 4, wherein the fixing device further includes a cover that has a vent hole and covers at least the second surface of the second supporting plate while including the resistance element.

7. The image forming apparatus according to claim 4, further comprising a fan that releases air in the inside of the image forming apparatus and causes air in the vicinity of the second rotating member to flow in a direction along the second rotating member, wherein the resistance element is arranged upstream from the second rotating member in the flow of the air in the vicinity of the second rotating member.

* * * * *